United States Patent [19]

Magnuson et al.

[11] 3,946,705

[45] Mar. 30, 1976

[54] HEAT ENGINE POWER SYSTEM

[75] Inventors: Roland A. Magnuson, Seattle, Wash.; Richard W. Siorek, Warren, Mich.

[73] Assignee: The United States of America as represented by the Secretary of the Army, Washington, D.C.

[22] Filed: Sept. 30, 1974

[21] Appl. No.: 510,525

[52] U.S. Cl.. 123/41.13; 123/139 BG; 123/140 MC

[51] Int. Cl.[2]..... F01P 7/02

[58] Field of Search... 123/41.13, 140 MC, 139 BG, 123/198

[56] References Cited

UNITED STATES PATENTS

| | | | |
|---|---|---|---|
| 2,205,651 | 6/1940 | Hoffman | 123/139 BG |
| 3,577,978 | 5/1971 | Garcea | 123/140 MC |
| 3,608,533 | 9/1971 | Mennesson | 123/140 MC |
| 3,727,598 | 4/1973 | Knapp | 123/140 MC |
| 3,739,760 | 6/1973 | Charron | 123/41.13 |
| 3,776,208 | 12/1973 | Stumpp | 123/140 MC |
| 3,855,975 | 12/1974 | Masaki | 123/41.13 |

FOREIGN PATENTS OR APPLICATIONS

| | | | |
|---|---|---|---|
| 930,049 | 7/1955 | Germany | 123/41.13 |

*Primary Examiner*—Charles J. Myhre
*Assistant Examiner*—Daniel J. O'Connor
*Attorney, Agent, or Firm*—Peter A. Taucher; John F. Schmidt; John E. McRae

[57] ABSTRACT

A heat engine power system includes a fluid fuel heat engine designed to predetermined performance characteristics for military vehicles, and a cooling subsystem which has enough capacity to carry away the rejected engine heat. When the exigencies of parts support require replacement of the original engine by a more powerful one which at high ambient temperatures and wide-open throttle would overload the cooling subsystem, the speed controls are such that either of two heat sensors closes an electric circuit to a solenoid which is energized to move the throttle to a given position to restrict fuel flow to an amount which limits engine output so that the rejected heat is within the capacity of the cooling subsystem, thus avoiding overheating and failure, and keeping the military equipment in service without permanently sacrificing total available horsepower.

7 Claims, 5 Drawing Figures

AIR CLEANER
GOVERNOR
FUEL TANK
ENGINE
P
P

HEAT ENGINE POWER SYSTEM

The invention described herein may be manufactured, used, and licensed by or for the Government for governmental purposes without payment to us of any royalty thereon.

BACKGROUND OF THE INVENTION

1. Field of the Invention

In heat engine power systems, especially those designed for military vehicular propulsion, it is the practice to maintain a design balance among all components of the system. Thus a vehicle carrying a heat engine power system is equipped with a fluid fuel heat engine having sufficient horsepower at the wheel contact points on the road to provide the desired performance characteristics. The power system carries a cooling subsystem which has the capacity to carry away the rejected heat of the heat engine under assumed conditions, but that subsystem is not designed to carry away the rejected heat that would be generated by a substantially larger engine.

In military equipment, such a design balance is likely to be closely engineered for optimum performance. For example, a personnel carrier, or a tank, must have the maximum mobility and maneuverability possible for its size and consistent with other necessary capabilities, and the stated equipment will not be provided with a cooling subsystem twice as big as needed to cool the propulsion engine in the equipment, because the extra weight of such an oversize cooling subsystem could be more usefully devoted to another man, more ammunition, more fuel, heavier armor, or the like.

It sometimes happens that the engines in equipment already in the field must, when rendered unserviceable, be replaced by somewhat larger engines (longer stroke, and/or larger bore, and therefore greater displacement) which fit in the available space and which also fit one or more larger lines of equipment. Use of the bigger engine in the smaller equipment overloads the cooling subsystem if the replacement engine is driven at wide-open throttle, especially when the equipment is run at high ambient air temperatures.

2. The Prior Art.

The quick and easy solution to the problem of cooling subsystem overload is to place a baffle plate or some other restriction in the fuel line, as for example in the intake manifold, to limit the power output of the larger engine to original levels. Such an expedient does prevent overloading of the cooling subsystem. The disadvantage of such a solution is that it limits power output at all times, even when ambient temperatures are low.

It therefore is desirable to have a heat engine power system which enables the users to take advantage of maximum engine horsepower as long as such operation can take place without serious risk of damage to some part of the power system. As an example, when ambient air temperatures are low, the cooling subsystem which uses ambient air to cool a circulated liquid coolant will have a substantially greater capacity to carry away the rejected heat of the heat engine than when ambient air temperatures are high, and the larger, more powerful, engine can be operated at maximum horsepower in such circumstances (low ambient temperature). This gives the troops greater mobility and greater striking power than a power system forced to operate at restricted power all the time. At the same time, the system which we propose here offers as much protection against overload damage as can be afforded with conventional safeguards such as a fixed restriction, and without the drawbacks.

SUMMARY OF THE INVENTION

This invention consists of a heat engine power system having a fluid fuel heat engine delivering a given maximum horsepower coupled with a cooling subsystem capable of carrying away the rejected heat of said engine; the speed control means in the system enables use in the system of a replacement, more powerful, fluid fuel heat engine capable of delivering a maximum horsepower so much greater than said given maximum horsepower that the cooling subsystem would be significantly overloaded if the replacement engine were operated at wide open throttle at high ambient temperatures. The speed control means comprises a throttle in the fuel-air conduit and operator-operable between wide-open and closed-throttle positions. An overspeed governor is integral with the speed control means. A temperature responsive means for detecting overloading of the cooling subsystem is connected to means for limiting the throttle opening to an operating position such that the more powerful replacement engine would produce rejected heat within the cooling capability of the cooling subsystem.

THE DRAWINGS

Figure 5:
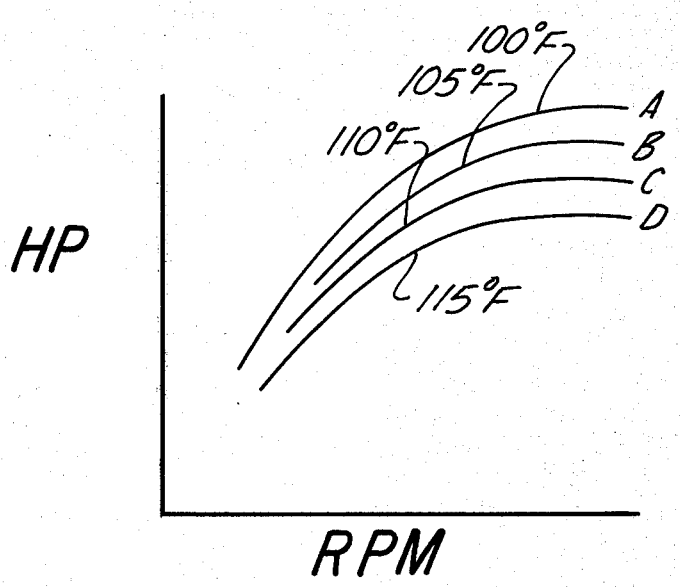

FIG. 5 presents a family of performance curves, plotting horsepower against engine RPM at four different ambient air temperatures.

DESCRIPTION OF THE EMBODIMENT SHOWN

It will be appreciated by those skilled in the art that the various elements of the system here illustrated are shown schematically. The carburetor art, for example, is very highly developed, and we do not deem it essential to show conventional details.

Figure 1:
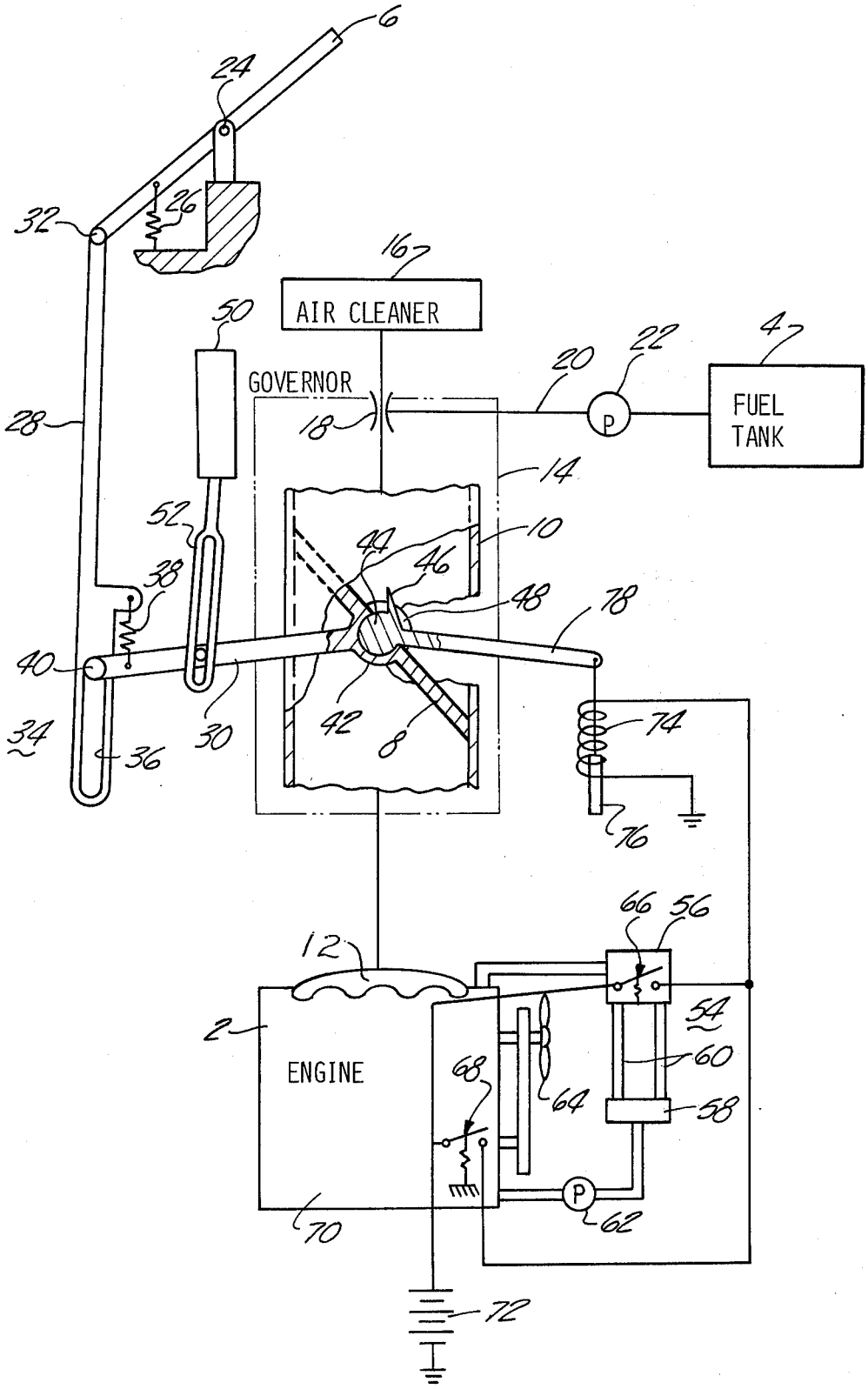
FIG. 1 is a schematic drawing of a heat engine power system made according to our invention, and showing the components in their de-energized, throttle-closed, position.
Figure 2:
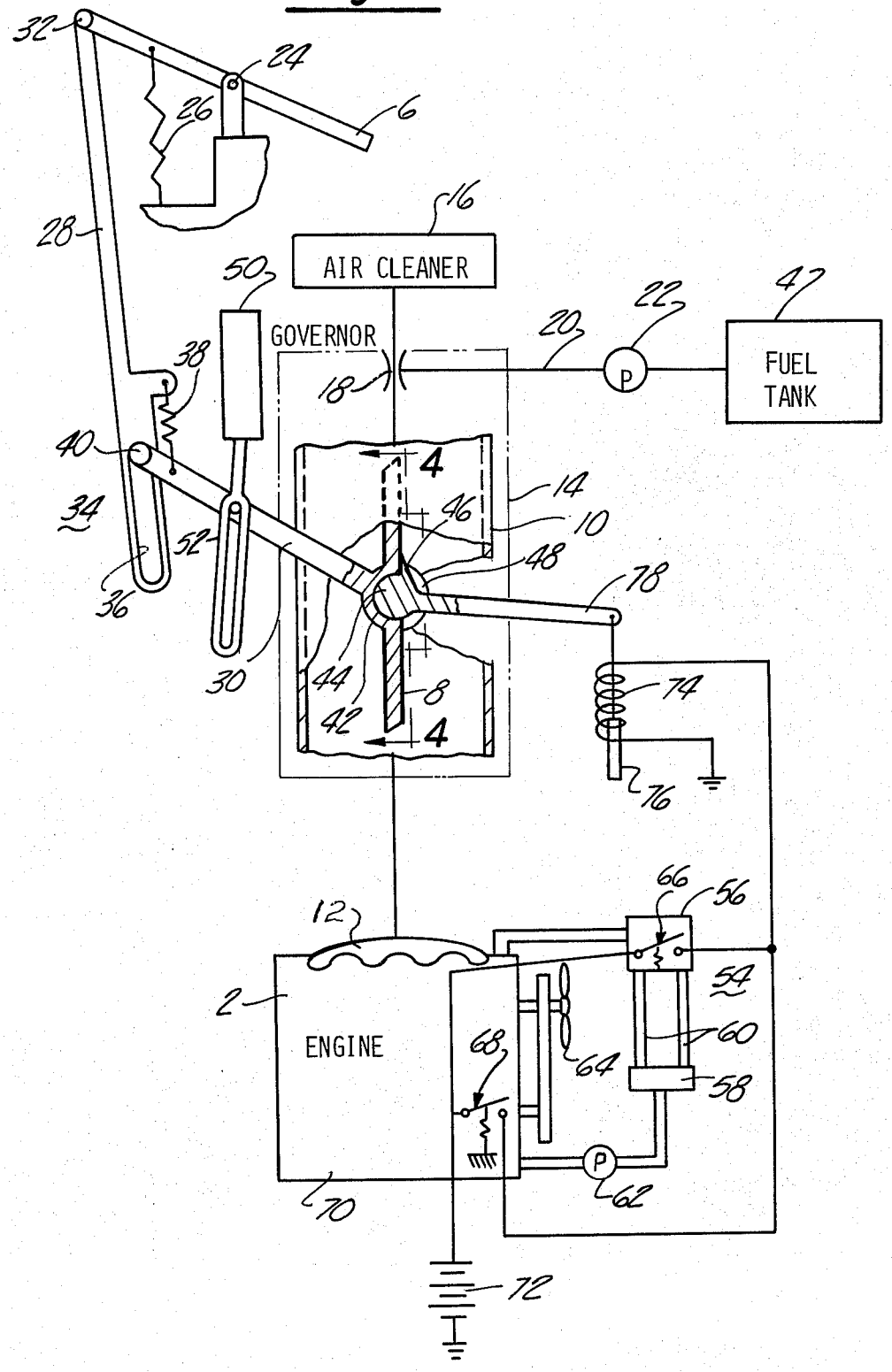
FIG. 2 is a view similar to FIG. 1, but showing the system at wide-open throttle; as here shown, the butterfly valve details reflect a view in section substantially on line 2—2 of FIG. 4.
Figure 3:
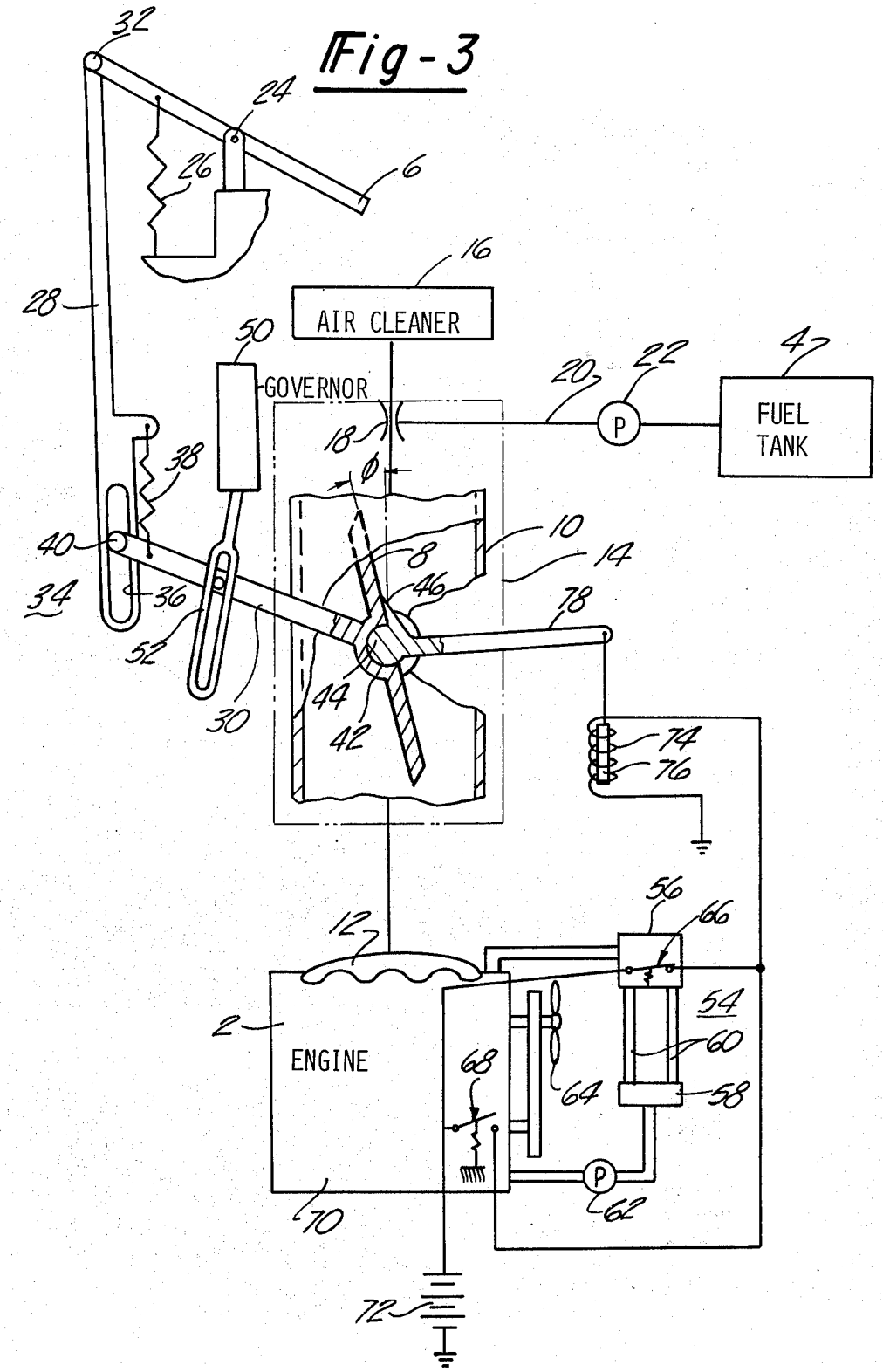
FIG. 3 is another view similar to FIG. 1, showing the system at restricted throttle to limit the power of the replacement engine so as to avoid overheating the engine or overloading the cooling subsystem.

The illustrated embodiment shows a heat engine power system wherein a fluid fuel heat engine 2 draws fuel from a fuel tank 4. Speed control means comprise an operator-operable element 6 connected to control a throttle here shown as a conventional butterfly valve 8 mounted in a carburetor barrel 10 so as to have: a throttle-closed position, as shown in FIG. 1; a wide-open throttle position, as shown in FIG. 2; and an infinite number of positions between the closed position of FIG. 1 and the open position of FIG. 2, of which the partially-closed position of FIG. 3 is one. The reason for illustrating the FIG. 3 position as a special case will become apparent in a detailed discussion infra.

More specifically, heat engine 2 here shown is a fluid fuel engine having an intake manifold 12 connected with barrel 10 of a conventional carburetor outlined at 14. An air cleaner 16 is connected to the carburetor, which is conventionally provided with a venturi 18 to which the source of fuel 4 is connected thru a conduit 20 and a pump 22.

Operator-operable means 6 is here illustrated as an accelerator pedal pivotally mounted at 24 and biased by spring 26 toward throttle-closed position. Linkage 28 is connected with the pedal and with a throttle actuator 30, the pedal connection being here illustrated schematically as a simple pivot 32, while the actuator connection is shown as a lost-motion connection 34 having a slot 36 and a spring 38. A pin 40 on actuator 30 is adapted to ride in slot 36; spring 38 is connected to bias pin 40 toward the upper end of slot 36, pin 40 being at the extreme upper end of slot 36 as shown in FIGS. 1 and 2. In FIG. 1, the throttle is closed; in FIG. 2 it is open, and pin 40 and slot 36 are positioned for positive movement of actuator 30 by linkage 28 toward throttle-closed position, and as shown in FIG. 1 for yieldably moving actuator 30 and throttle 8 toward a throttle-open position.

Figure 4:
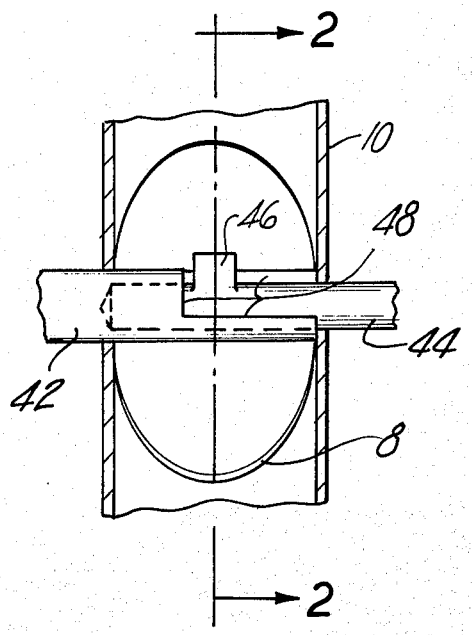
FIG. 4 is a view in section thru a carburetor throttle, being a section substantially on line 4—4 of FIG. 2.

Throttle 8 is here shown as integral with a quill shaft 42. As is best seen in FIG. 4, quill shaft 42 is at least partially supported on a spindle 44 which carries a substantially tangential projection or dog 46. Dog 46 is engageable with butterfly valve 8 for closing action (counterclockwise rotation of spindle 44) but cannot by itself open butterfly valve 8. To allow free passage of dog 46 axially for assembly purposes, and to permit arcuate movement of dog 46, quill shaft 42 is slotted as shown at 48.

Suitable conventional protection against overspeed operation of the engine is provided. As here shown, an overspeed governor 50 connects by a slotted link 52 with throttle actuator 30.

Engine 2 is cooled by a liquid coolant circulated in a closed system which includes a heat exchanger 54, here shown as a conventional radiator having a top tank 56 connected to receive hot water from engine 2, a bottom tank 58 connected to supply cooled water to the engine cooling jacket, heat exchanger tubes 60 connecting the top and bottom tanks, a water pump 62, and a fan 64 preferably engine-driven to draw cold air over tubes 60.

Two conventional temperature-responsive sensors 66 and 68 are placed in top tank 56 and in the engine crankcase 70, respectively. These sensors are stock items, consisting of two internal fixed contacts connected with external terminals, a movable bridging contact adapted to establish an electric circuit, or break such circuit, between the two fixed contacts, and a temperature-sensitive element connected to move the bridging contact into and out of circuit making position.

The sensors are normally open circuit types, i.e., under normal operating conditions, the bridging contact does not complete an electric circuit between the two external terminals, but when a predetermined maximum temperature is reached, the temperature-sensitive element moves the bridging contact into engagement with the two fixed contacts to establish an electric circuit between the two external terminals, moving out of bridging position when the medium in which it is immersed cools back down to a predetermined temperature which is usually several degrees below said maximum temperature.

A conventional electric power source 72 is connected in parallel with the two sensors, to the coil 74 of a solenoid, whereby the solenoid coil is energized when either of the two sensors closes a circuit between its terminals. An armature 76 is adapted to have two operating positions, one of those shown in FIGS. 1 and 2 with coil 74 deenergized, and the other shown in FIG. 3 in which coil 74 is energized. Armature 76 is connected to pivot an arm 78 on spindle 44 into one of two corresponding operating positions for dog 46, namely the position shown in FIGS. 1 and 2 wherein dog 46 offers no bar to opening the throttle wide; the other position is shown in FIG. 3 in which dog 46 is shown turned counterclockwise from its wide-open position by an angle $\phi$, wherein butterfly valve 8 partially restricts the flow of fuel and air in barrel 10.

OPERATION

It will be recalled from the introduction supra that the invention comprehends a balanced heat engine power system for military equipment wherein a heat engine provides the power needed to accomplish carefully predetermined performance characteristics. In the course of performance, the heat engine generates rejected heat which is carried away by a balanced design cooling subsystem.

If enemy action knocks out the engine, it often happens that an immediately available replacement engine is one which fits the mounting and power train interfaces but which delivers a maximum horsepower substantially greater than the maximum horsepower of the original engine and, at high ambient temperatures, generates at wide-open throttle more rejected heat than the cooling subsystem can carry away due to the fact that it is designed to carry away the rejected heat of the smaller engine.

In FIG. 5, curves A, B, C, and D show plotted horsepower at ambient air temperatures of 100°F, 105°F, 110°F, and 115°F for the larger, replacement, engine. Curve D also shows the maximum horsepower of the replacement engine for the amount of rejected heat that is within the capability of the cooling subsystem.

If the replacement engine is provided with a fixed restriction to limit fuel intake to a quantity which limits engine output to that shown by curve D, the restriction works at all ambient temperatures, which results in horsepower losses (because the higher power is unavailable) at the lower ambient temperatures, in accordance with curves A, B, and C. A tank which could be operated at 100°F ambient with the horsepower available as shown in curve A, without restriction, and do so without risk of damage to the heat engine power system, is nevertheless forced to function at a disadvantage, if the tank is provided with a replacement engine that is hobbled in the way that conventional methods solve the problem of too much power, i.e., with a fixed restriction. The added performance available at curve A might be exactly the margin needed for survival in combat, where speed and maneuverability are of the greatest importance.

To summarize the operation of an improved heat engine power system such as is herein disclosed and claimed, we again point out that the environment in which the invention is practiced is a carefully design-balanced heat engine power system, wherein the heat engine originally in the system has been disabled, as for example by enemy action, and to keep the equipment in service, the maintenance troops replace the disabled engine with an immediately available engine which happens to be more powerful than the original-equipment engine.

For so long a time as the operating conditions, such as low ambient cooling air temperatures, permit operation of the equipment at maximum horsepower of the replacement engine without destructive overheating of the system, sensors 66 and 68 remain in their normally-open circuit condition, and the operator can freely run the equipment at wide-open throttle if the need arises.

When conditions change such that operation at wide-open throttle would cause destructive overheating of the system, one, and possibly both, of the sensors 66 and 68 will close to complete a circuit for coil 74, moving arm 78 and dog 46 from the operating position shown in FIGS. 1 and 2 to the operating position shown in FIG. 3. With dog 46 in its FIG. 3 operating position, butterfly valve 8 is no longer free to move to its wide-open throttle position it occupies in FIG. 2 but is limited to a position less than wide open by the angle $\phi$ shown in FIG. 3.

If the operator then moves pedal 6 to its wide-open throttle position, as soon as butterfly valve 8 comes into contact with dog 46, further advancement of the speed controls merely serves to stretch spring 38, shown somewhat exaggerated in FIG. 3 to illustrate the principle of operation.

We wish it to be understood that we do not desire to be limited to the exact details of construction shown and described, for obvious modifications will occur to a person skilled in the art.

We claim:

1. A heat engine power system wherein a fluid fuel heat engine of a given maximum power capability rejects heat at a given maximum rate, a cooling subsystem connected to carry away the rejected heat of said engine and having a maximum cooling capacity capable of carrying away heat at said given maximum rate, and wherein a second fluid fuel heat engine of a larger power capability is capable of rejecting heat at greater than said given maximum rate and is a replacement in the system for the first-named engine, the invention consisting of fuel controls enabling use of either engine without overloading the cooling subsystem, the system comprising:

a. a throttle having a first operating position in which the throttle is capable of admitting as much fuel as will enable operation of the first-named engine at its maximum output and within the cooling capacity of the cooling subsystem and would enable operation of the replacement engine at its maximum output and rejecting heat at a substantially greater rate than said given maximum rate, which substantially greater rate would overload the cooling subsystem and cause mechanical failure of the system, and a second operating position in which the throttle limits fuel flow to the replacement engine to a rate which limits heat rejection by the replacement engine to a rate that is within the cooling capability of the cooling subsystem;

b. speed control means operably connected to actuate the throttle throughout its entire operating range including said first and second operating positions;

c. temperature-responsive means for detecting overloading of the cooling subsystem; and d. means under control of the temperature responsive means for limiting the throttle opening to said second operating position.

2. A system as in claim 1, wherein the cooling subsystem is a liquid coolant system, and the temperature-responsive means is located in the subsystem and senses coolant temperature.

3. A system as in claim 1, wherein the temperature-responsive means includes a sensor located in the cooling subsystem and a second sensor for responding to lubricant temperatures.

4. A system as in claim 1, in which the speed control means comprises operator-operable means and a governor-actuated maximum speed override; and said means under control of the temperature-responsive mean is connected with the speed control means.

5. A system as in claim 4, wherein the speed control means comprises:

a. linkage mounted for positive movement by the operator-operable means in a direction to open the throttle against resilient means connected to bias the linkage toward closed-throttle position;

b. a throttle actuator movable between throttle-open and throttle-closed positions; and c. lost-motion means connecting the linkage and the throttle actuator for positive movement of the actuator by the linkage toward throttle-closed position and having a resilient connection for yieldably moving the actuator toward throttle-open position.

6. A system as in claim 5, wherein the temperature-responsive means includes an electric circuit comprising:

a. a source of electrical energy;

b. a solenoid having an operating coil an an armature; and c. means for connecting the electrical energy source with said coil and including said temperature-responsive means in the form of a normally open-circuit sensor.

7. A system as in claim 1, wherein the temperature-responsive means includes an electric circuit comprising:

a. a source of electrical energy;

b. a solenoid having an operating coil and an armature; and c. means for connecting the electrical energy source with said coil and including said temperature-responsive means in the form of a normally open-circuit sensor.

* * * * *